US006440011B1

(12) United States Patent
Hocknell et al.

(10) Patent No.: US 6,440,011 B1
(45) Date of Patent: Aug. 27, 2002

(54) METHOD FOR PROCESSING A STRIKING PLATE FOR A GOLF CLUB HEAD

(75) Inventors: Alan Hocknell, Cardiff; J. Andrew Galloway, Escondido; Richard C. Helmstetter, Carlsbad; Ronald C. Boyce, San Diego, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/548,531

(22) Filed: Apr. 13, 2000

Related U.S. Application Data

(63) Continuation-in-part of application No. 09/431,982, filed on Nov. 1, 1999.

(51) Int. Cl.[7] ..... A63B 53/04; A63B 53/06; A63B 53/08; B21B 1/46; B21B 13/22; C22F 1/18

(52) U.S. Cl. ..... 473/342; 473/342; 473/345; 473/409; 473/349; 29/527.2; 29/527.4; 148/669

(58) Field of Search ..... 473/342, 349, 473/409; 148/330, 345, 527, 537, 669, 670, 671; 29/527.4, DIG. 18, DIG. 16, 527.2; 72/340, 364, 377

(56) References Cited

U.S. PATENT DOCUMENTS

| | | | | |
|---|---|---|---|---|
| 4,687,205 A | | 8/1987 | Tominaga et al. | |
| 5,172,913 A | | 12/1992 | Bouquet | |
| 5,261,663 A | | 11/1993 | Anderson | |
| 5,261,664 A | | 11/1993 | Anderson | |
| 5,272,802 A | | 12/1993 | Stites, III | |
| 5,344,140 A | | 9/1994 | Anderson | |
| 5,346,217 A | | 9/1994 | Tsuchiya et al. | |
| 5,429,357 A | | 7/1995 | Kobayashi | |
| 5,460,371 A | | 10/1995 | Takeda | |
| 5,464,216 A | | 11/1995 | Hoshi et al. | |
| 5,485,998 A | | 1/1996 | Kobayashi | |
| 5,501,459 A | | 3/1996 | Endo | |
| 5,527,034 A | | 6/1996 | Ashcraft et al. | |
| 5,556,097 A | | 9/1996 | Endo et al. | |
| 5,776,011 A | | 7/1998 | Su et al. | |
| 5,788,584 A | | 8/1998 | Parente et al. | |
| 5,797,807 A | | 8/1998 | Moore | |
| 5,830,084 A | * | 11/1998 | Kosmatka | 473/349 |
| 6,089,070 A | * | 7/2000 | Hancock et al. | 473/345 |
| 6,145,365 A | * | 11/2000 | Miyaha | 72/332 |
| 6,183,570 B1 | * | 2/2001 | Kawaguchi et al. | 148/243 |
| 6,193,614 B1 | * | 2/2001 | Sasamoto et al. | 473/329 |

FOREIGN PATENT DOCUMENTS

| | | |
|---|---|---|
| JP | 05116557 | 4/1993 |
| JP | 07216213 | 8/1995 |
| JP | 09235312 | 7/1997 |
| JP | 10028281 | 2/1998 |

* cited by examiner

*Primary Examiner*—Paul T. Sewell
*Assistant Examiner*—Sneh Varma
(74) *Attorney, Agent, or Firm*—Michael A. Catania

(57) ABSTRACT

A method for producing a forged striking plate for a golf club is disclosed herein. The forging process involves multiple heating and pressing of a metal bar to obtain a final face member configuration. The heating of the metal bar is performed at temperatures below 1000° C. for less than twenty minutes. The final face member configuration has a striking plate with regions of variable thickness. The metal bar is preferably composed of a forged titanium material.

15 Claims, 11 Drawing Sheets

METHOD FOR PROCESSING A STRIKING PLATE FOR A GOLF CLUB HEAD

CROSS REFERENCES TO RELATED APPLICATIONS

The present application is a continuation-in-part application of co-pending U.S. patent application Ser. No. 09/431,982, filed on Nov. 1, 1999, for A Golf Club Head With A Face Composed Of A Forged Material.

STATEMENT REGARDING FEDERALLY SPONSORED RESEARCH OR DEVELOPMENT

Not Applicable

BACKGROUND OF THE INVENTION

1. Field of the Invention

The present invention relates to a method for processing a striking plate for a golf club head. More specifically, the present invention relates to a method for forging a relatively thin metal striking plate for a golf club head.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses.

The typical forging process for metal golf club faces involves heating the metal bar at a temperature in excess of 1000° C. for longer than twenty minutes, pressing and then repeating the process. The forged face is then milled or ground to obtain the proper face thickness. Thus, all current golf club face plates that claim to be forged, actually have undergone a post-forging milling or grinding to achieve a proper thickness, and proper bulge and roll. Therefore, the golf industry is absent a truly forged face plate.

BRIEF SUMMARY OF THE INVENTION

The present invention provides a method for producing a face member for golf club head that has a relatively thin striking plate, and that is forged to a finished state. The thin striking plate allows for greater compliance of the striking plate with a golf ball during impact. A more compliant striking plate provides for lower energy loss and a higher coefficient of restitution.

One aspect of the present invention is a method for producing a golf club head with a finished forged striking plate. The method includes heating a metal bar to a temperature less than 1000° C. for less than 20 minutes, and then pressing the heated metal bar into an L-shape metal bar. Next, the L-shape metal bar is again heated to a temperature less than 1000° C. for less than 20 minutes, and then pressed into an intermediate shape face member. Next, the intermediate shape face member is glassed with a ceramic compound. Next, the glassed intermediate shape face member is heated to a temperature less than 1000° C. for less than 20 minutes, and then pressed into a final face member configuration.

The method may also includes additional heating and pressing at even lower temperatures and at a lowered pressure to finalize the bulge and roll of a striking plate of the final face member configuration. The preferred metal is titanium, and most preferably beta-titanium. The multiple heating and pressing provides a thin face with greater durability.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
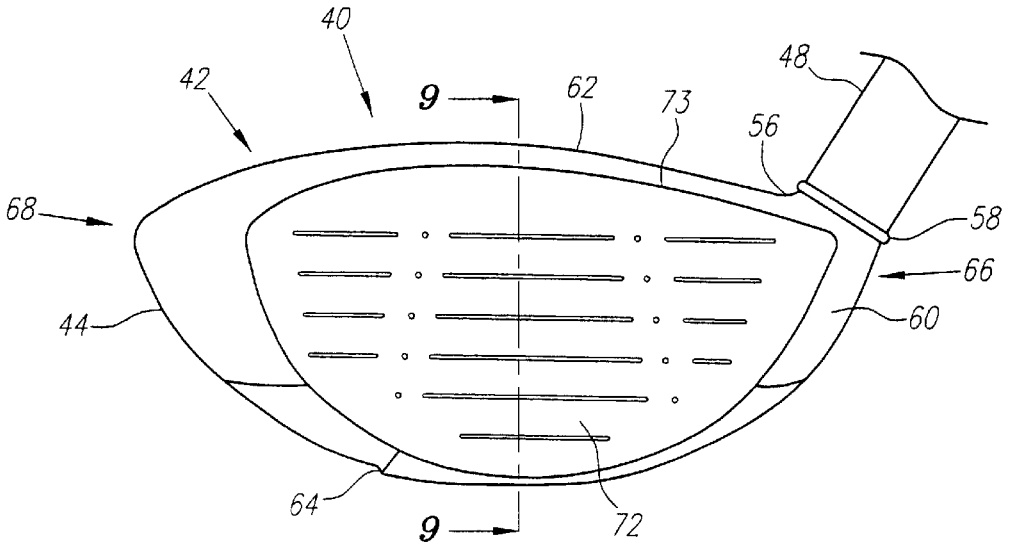
FIG. 1 is a front view of a golf club produced according to the method of the present invention.

The present invention is directed at a method for producing a golf club head with a forged, relatively thin, striking plate thereby allowing for greater compliance of the striking plate during impact with a golf ball. The compliant striking plate allows for a high coefficient of restitution thereby allowing for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face. The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a striking plate or face with a coefficient of restitution approaching 0.93, as measured under conventional test conditions.

As shown in FIGS. 1–5, a golf club is generally designated 40. Such a golf club is described in greater detail in co-pending U.S. patent application Ser. No. 09/431,982, filed on Nov. 1, 1999, for A Golf Club Head With A Face Composed Of A Forged Material, which is hereby incorporated by reference in its entirety. The golf club 40 has a golf club head 42 with a body 44 and a hollow interior, not shown. Engaging the club head 42 is a shaft 48 that has a grip 50, not shown, at a butt end 52 and is inserted into a hosel 54 at a tip end 56. An O-ring 58 may encircle the shaft 48 at an aperture 59 to the hosel 54.

The body 44 of the club head 42 is generally composed of four sections, the hosel 54, a face member 60, a crown 62 and a sole 64. The club head 42 may also be partitioned into a heel section 66 nearest the shaft 48, a toe section 68 opposite the heel section 66, and a rear section 70 opposite the face member 60.

The face member 60 is generally composed of a single piece of forged metal, and is preferably composed of a forged titanium material. The face member 60 generally includes a striking plate (also referred to herein as a face plate) 72 and a face extension 74 extending laterally inward from the perimeter of the striking plate 72. The striking plate 72 has a plurality of scorelines 75 thereon. A more detailed explanation of the scorelines 75 is set forth in co-pending U.S. patent application Ser. No. 09/431,521, filed on Nov. 1, 1999, entitled Contoured Scorelines For The Face Of A Golf Club, and incorporated by reference in its entirety. The face extension 74 generally includes an upper lateral extension 76, a lower lateral extension 78, a heel wall 80 and a toe wall 82.

Figure 2:
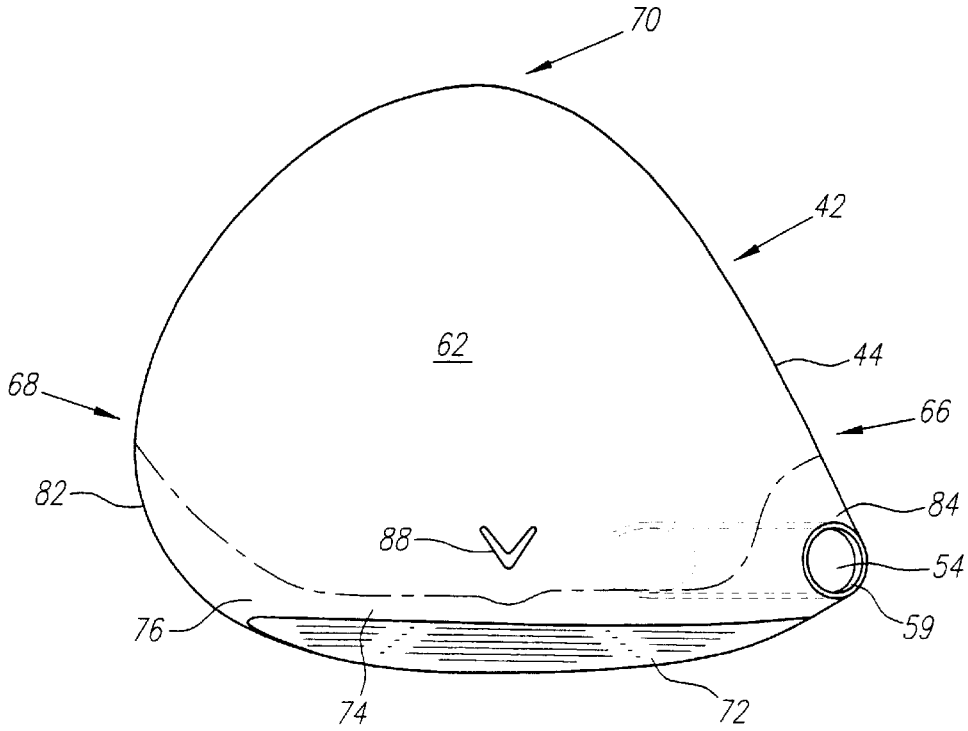
FIG. 2 is a top plan view of golf club head of FIG. 1.
Figure 2A:
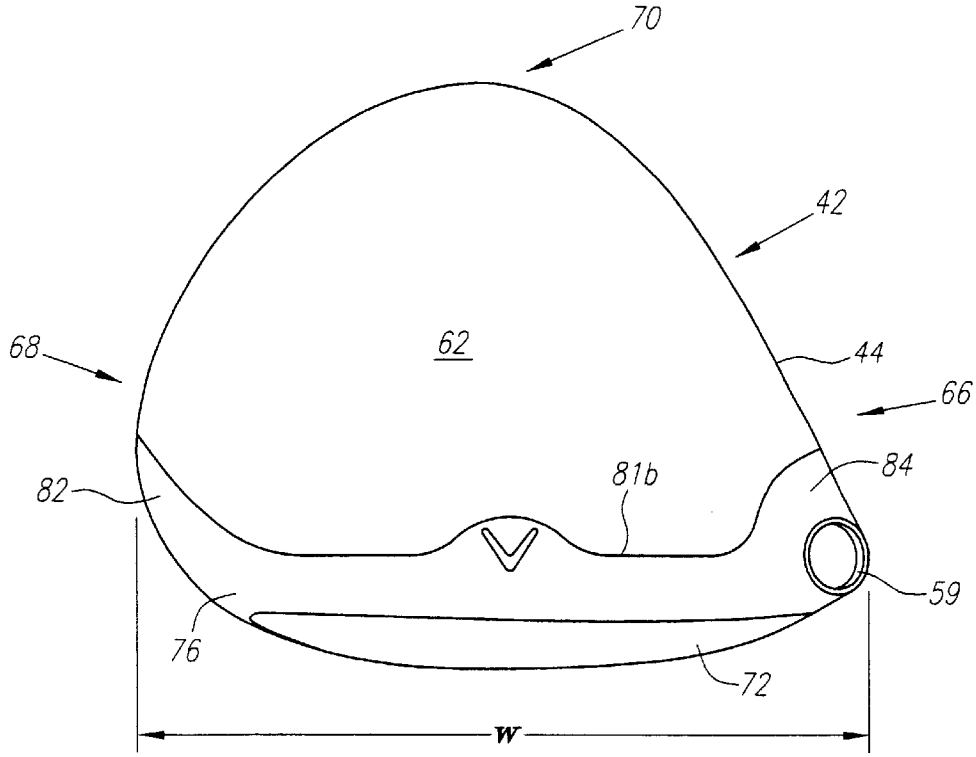
FIG. 2A is a top plan view of an alternative embodiment of a golf club produced according to the method of the present invention.
Figure 3:
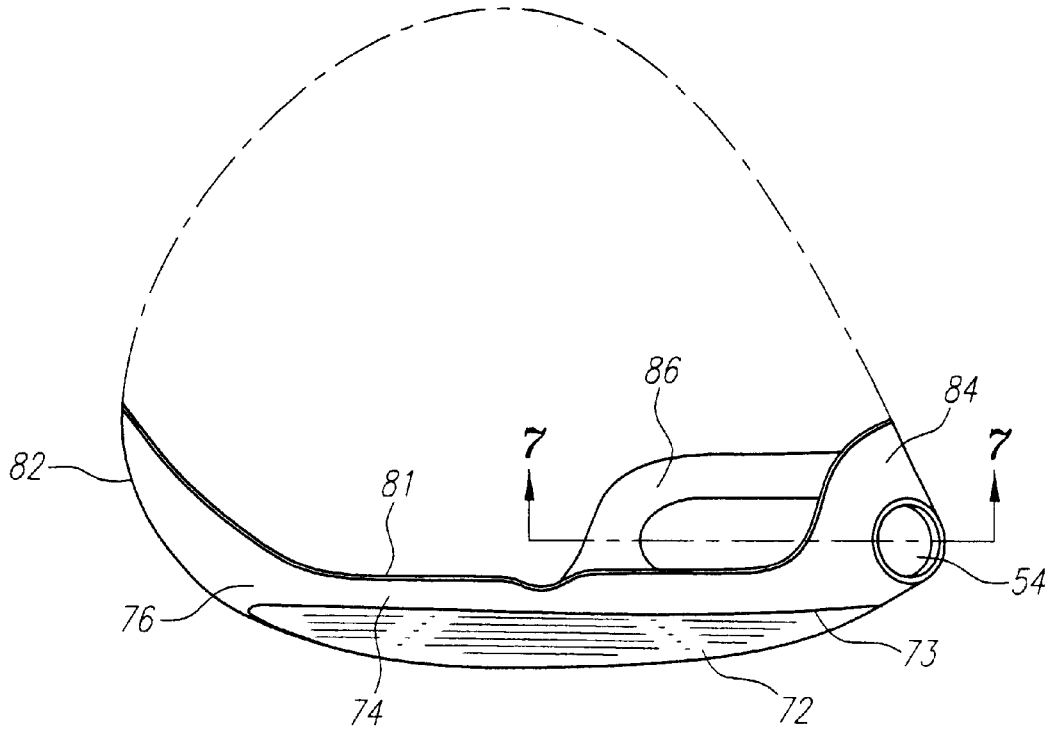
FIG. 3 is a top plan isolated view of the face member of a golf club head produced according to the method of the present invention with the crown in phantom lines.
Figure 4:
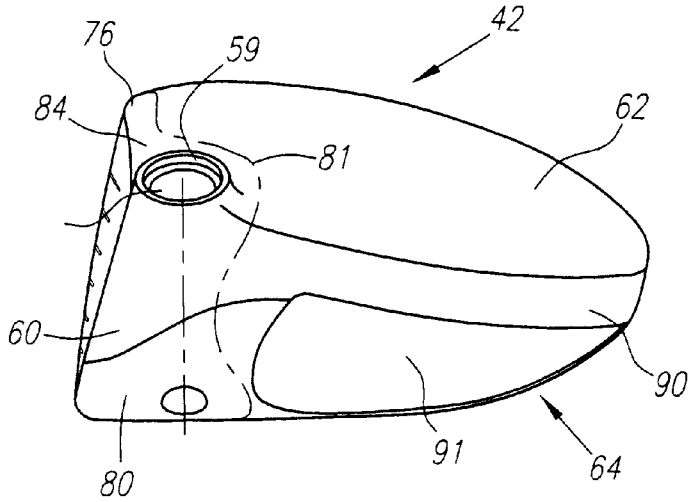
FIG. 4 is a side plan view of a golf club head produced according to the method of the present invention.
Figure 4A:
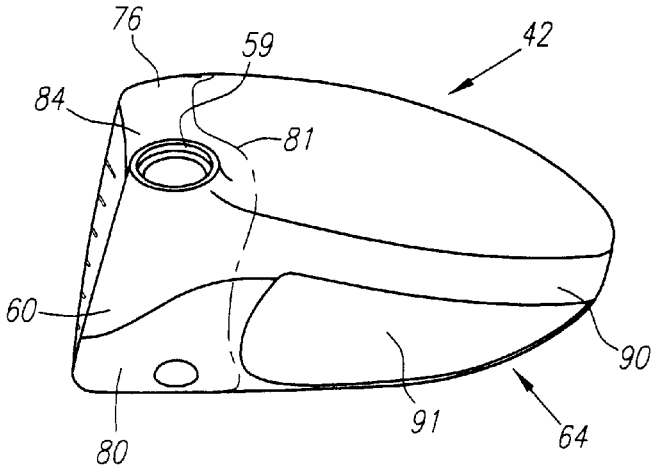
FIG. 4A is a side plan view of an alternative embodiment of a golf club head produced according to the method of the present invention.
Figure 5:
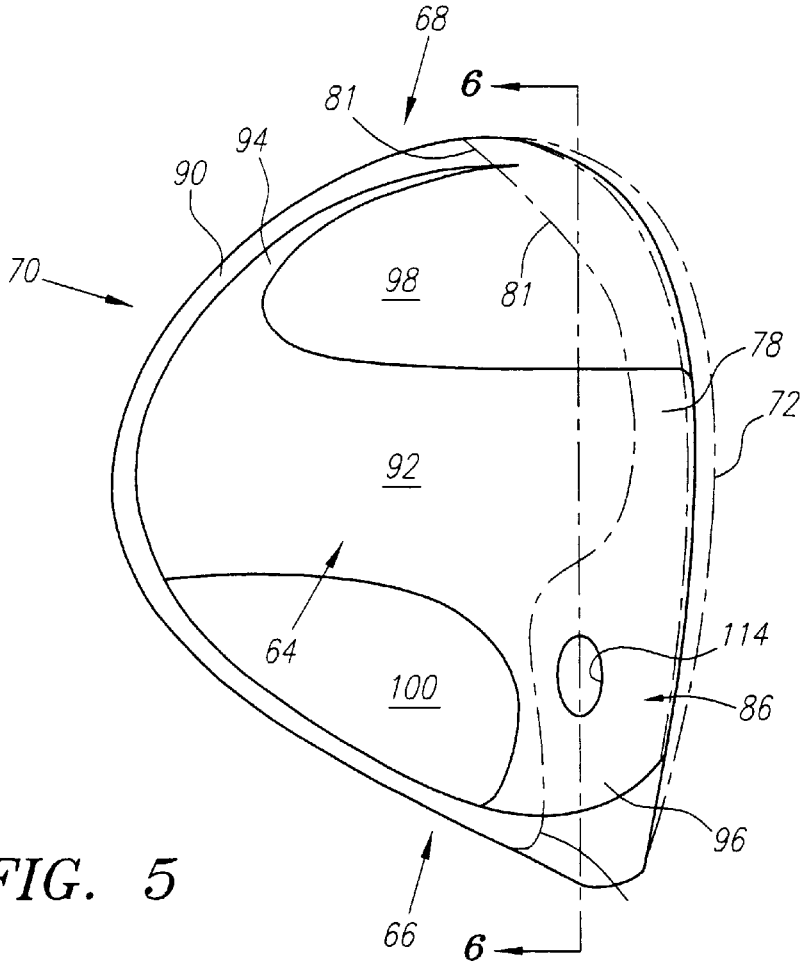
FIG. 5 is a bottom view of a golf club head produced according to the method of the present invention.

The upper lateral extension 76 extends inward, toward the hollow interior 46, a predetermined distance to engage the crown 62. In a preferred embodiment, the predetermined distance ranges from 0.2 inch to 1.0 inch, as measured from the perimeter 73 of the face plate 72 to the edge of the upper lateral extension 76. Unlike the prior art which has the crown engage the face plate perpendicularly, the present invention has the face member 60 engage the crown 62 along a substantially horizontal plane. Such engagement enhances the flexibility of the striking plate 72 allowing for a greater coefficient of restitution. The crown 62 and the upper lateral extension 76 are secured to each other through welding or the like along the engagement line 81. As illustrated in FIG. 2A, in an alternative embodiment, the upper lateral extension 76 engages the crown 62 at a greater distance inward thereby resulting in a weld that is more rearward from the stresses of the striking plate 72 than that of the embodiment of FIG. 2.

The uniqueness of the present invention is further demonstrated by a hosel section 84 of the upper lateral extension 76 that encompasses the aperture 59 leading to the interior hosel 54. The hosel section 84 has a width $w_1$ that is greater than a width $w_2$ of the entirety of the upper lateral extension 76. The hosel section 84 gradually transitions into the heel wall 80. The heel wall 80 is substantially perpendicular to the striking plate 72, and the heel wall 80 covers the interior hosel 54 before engaging a ribbon 90 and a bottom section 91 of the sole 64. The heel wall 80 is secured to the sole 64, both the ribbon 90 and the bottom section 91, through welding or the like.

At the other end of the face member 60 is the toe wall 82 which arcs from the striking plate 72 in a convex manner. The toe wall 82 is secured to the sole 64, both the ribbon 90 and the bottom section 91, through welding or the like.

The lower lateral extension 78 extends inward, toward the hollow interior 46, a predetermined distance to engage the sole 64. In a preferred embodiment, the predetermined distance ranges from 0.2 inches to 1.0 inches, as measured from the perimeter 73 of the striking plate 72 to the end of the lower lateral extension 78. Unlike the prior art which has the sole plate engage the face plate perpendicularly, the present invention has the face member 60 engage the sole 64 along a substantially horizontal plane. This engagement moves the weld heat affected zone rearward from a strength critical crown/face plate radius region. Such engagement enhances the flexibility of the striking plate 72 allowing for a greater coefficient of restitution. The sole 64 and the lower lateral extension 78 are secured to each other through welding or the like, along the engagement line 81. The uniqueness of the present invention is further demonstrated by a bore section 86 of the lower lateral extension 78 that encompasses a bore 114 in the sole 64 leading to the interior hosel 54. The bore section 86 has a width $w_3$ that is greater than a width $w_4$ of the entirety of the lower lateral extension 78. The bore section 86 gradually transitions into the heel wall 80.

The crown 62 is generally convex toward the sole 64, and engages the ribbon 90 of sole 64 outside of the engagement with the face member 60. The crown 62 may have a chevron decal 88, or some other form of indicia scribed therein that may assist in alignment of the club head 42 with a golf ball. The crown 62 preferably has a thickness in the range of 0.025 to 0.060 inch, and more preferably in the range of 0.035 to 0.043 inch, and most preferably has a thickness of 0.039 inch. The crown 62 is preferably composed of a hot formed or "coined" material such as a sheet titanium. However, those skilled in the pertinent art will recognize that other materials or forming processes may be utilized for the crown 62 without departing from the scope and spirit of the present invention.

The sole 64 is generally composed of the bottom section 91 and the ribbon 90 that is substantially perpendicular to the bottom section 91. The bottom section 91 is generally convex toward the crown 62. The bottom section has a medial ridge 92 with a first lateral extension 94 toward the toe section 68 and a second lateral extension 96 toward the heel section 66. The medial ridge 92 and the first lateral extension 94 define a first convex depression 98, and the medial ridge 92 and the second lateral extension 96 define a second convex depression 100. A more detailed explanation of the sole 64 is set forth in U.S. Pat. No. 6,007,433, filed on Apr. 2, 1998, for a Sole Configuration For Golf Club Head, which is hereby incorporated by reference in its entirety. The sole 64 preferably has a thickness in the range of 0.025 to 0.060 inch, and more preferably 0.047 to 0.055 inch, and most preferably has a thickness of 0.051 inch. The sole 64 is preferably composed of a hot formed or "coined" metal material such as a sheet titanium material. However, those skilled in the pertinent art will recognize that other materials and forming processes may be utilized for the sole 64 without departing from the scope and spirit of the present invention.

Figure 6:
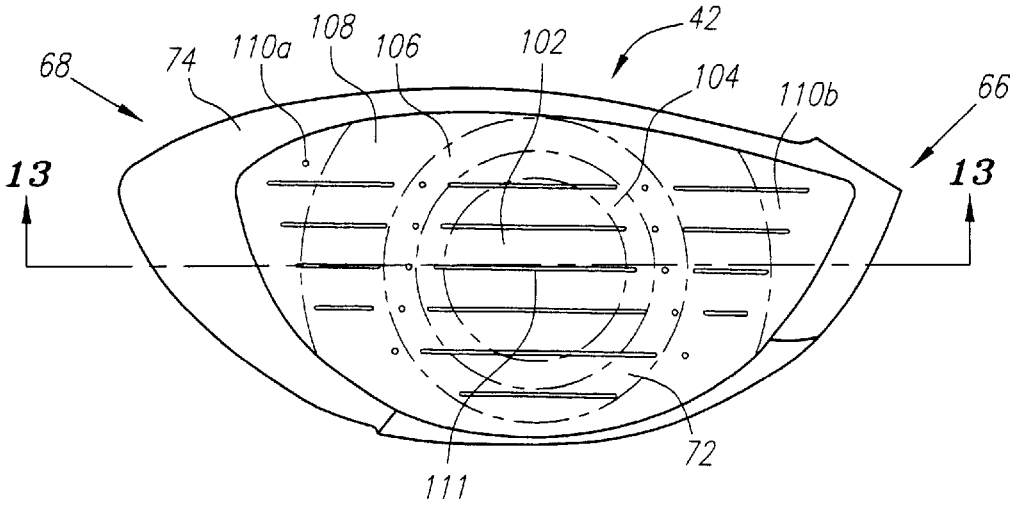
FIG. 6 is a front view of the golf club head produced according to the method of the present invention illustrating the variations in thickness of the striking plate.
Figure 7:
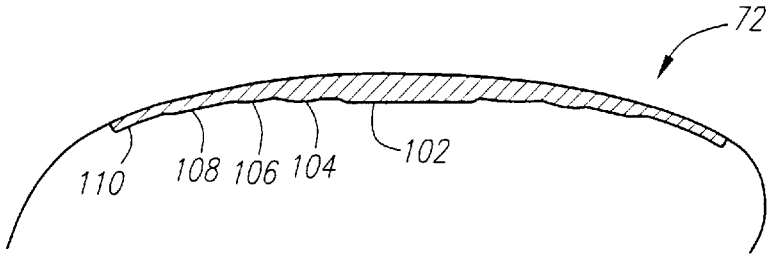
FIG. 7 is an isolated top view of the striking plate illustrating the variable face thickness.

FIGS. 6 and 7 illustrate the variation in the thickness of the striking plate 72. The face plate or striking plate 72 is partitioned into elliptical regions, each having a different thickness. A central elliptical region 102 preferably has the greatest thickness that ranges from 0.110 inch to 0.090 inch, preferably from 0.103 inch to 0.093 inch, and is most preferably 0.095 inch. A first concentric region 104 preferably has the next greatest thickness that ranges from 0.097 inch to 0.082 inch, preferably from 0.090 inch to 0.082 inch, and is most preferably 0.086 inch. A second concentric region 106 preferably has the next greatest thickness that ranges from 0.094 inches to 0.070 inch, preferably from 0.078 inch to 0.070 inch, and is most preferably 0.074 inch. A third concentric region 108 preferably has the next greatest thickness that ranges from 0.090 inch to 0.07 inch. A periphery region 110 preferably has the next greatest thickness that ranges from 0.069 inch to 0.061 inch. The periphery region includes toe periphery region 110*a* and heel periphery region 110*b*. The variation in the thickness of the striking plate 72 allows for the greatest thickness to be distributed in the center 111 of the striking plate 72 thereby enhancing the flexibility of the striking plate 72 which corresponds to a greater coefficient of restitution.

Figure 1A:
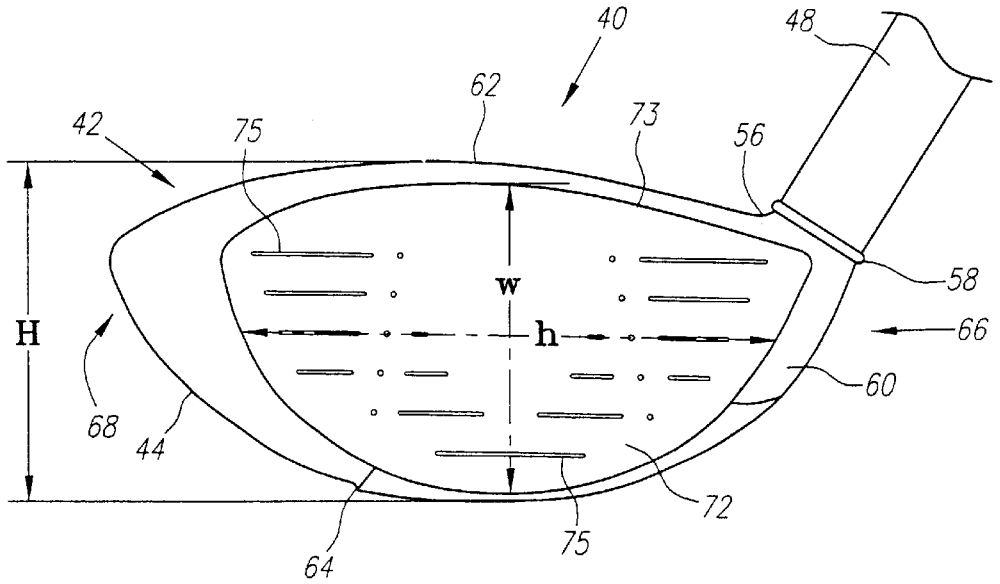
FIG. 1A is a front view of an alternative embodiment of a golf club produced according to the method of the present invention.

Additionally, the striking plate 72 of the present invention has a smaller aspect ratio than face plates of the prior art. The aspect ratio as used herein is defined as the width, "w", of the face divided by the height, "h", of the face, as shown in FIG. 1A. In one embodiment, the width w is 78 millimeters and the height h is 48 millimeters giving an aspect ratio of 1.635. In conventional golf club heads, the aspect ratio is usually much greater than 1. For example, the original GREAT BIG BERTHA® driver had an aspect ratio of 1.9. The face of the present invention has an aspect ratio that is no greater than 1.7. The aspect ratio of the present invention preferably ranges from 1.0 to 1.7. One embodiment has an aspect ratio of 1.3. The face of the present invention is more circular than faces of the prior art. The face area of the striking plate 72 of the present invention ranges 4.00 square inches to 7.50 square inches, more preferably from 4.95 square inches to 5.1 square inches, and most preferably from 4.99 square inches to 5.06 square inches.

The club head 42 of the present invention also has a greater volume than a club head of the prior art while maintaining a weight that is substantially equivalent to that of the prior art. The volume of the club head 42 of the present invention ranges from 175 cubic centimeters to 400 cubic centimeters, and more preferably ranges from 300 cubic centimeters to 310 cubic centimeters. The weight of the club head 42 of the present invention ranges from 165 grams to 300 grams, preferably ranges from 175 grams to 225 grams, and most preferably from 188 grams to 195 grams. The depth of the club head from the striking plate 72 to the rear section of the crown 62 preferably ranges from 3.606 inches to 3.741 inches. The height, "H", of the club head 42, as measured while in striking position, preferably ranges from 2.22 inches to 2.27 inches, and is most preferably 2.24 inches. The width, "W", of the club head 42 from the toe section 68 to the heel section 66 preferably ranges from 4.5 inches to 4.6 inches.

Figure 8:
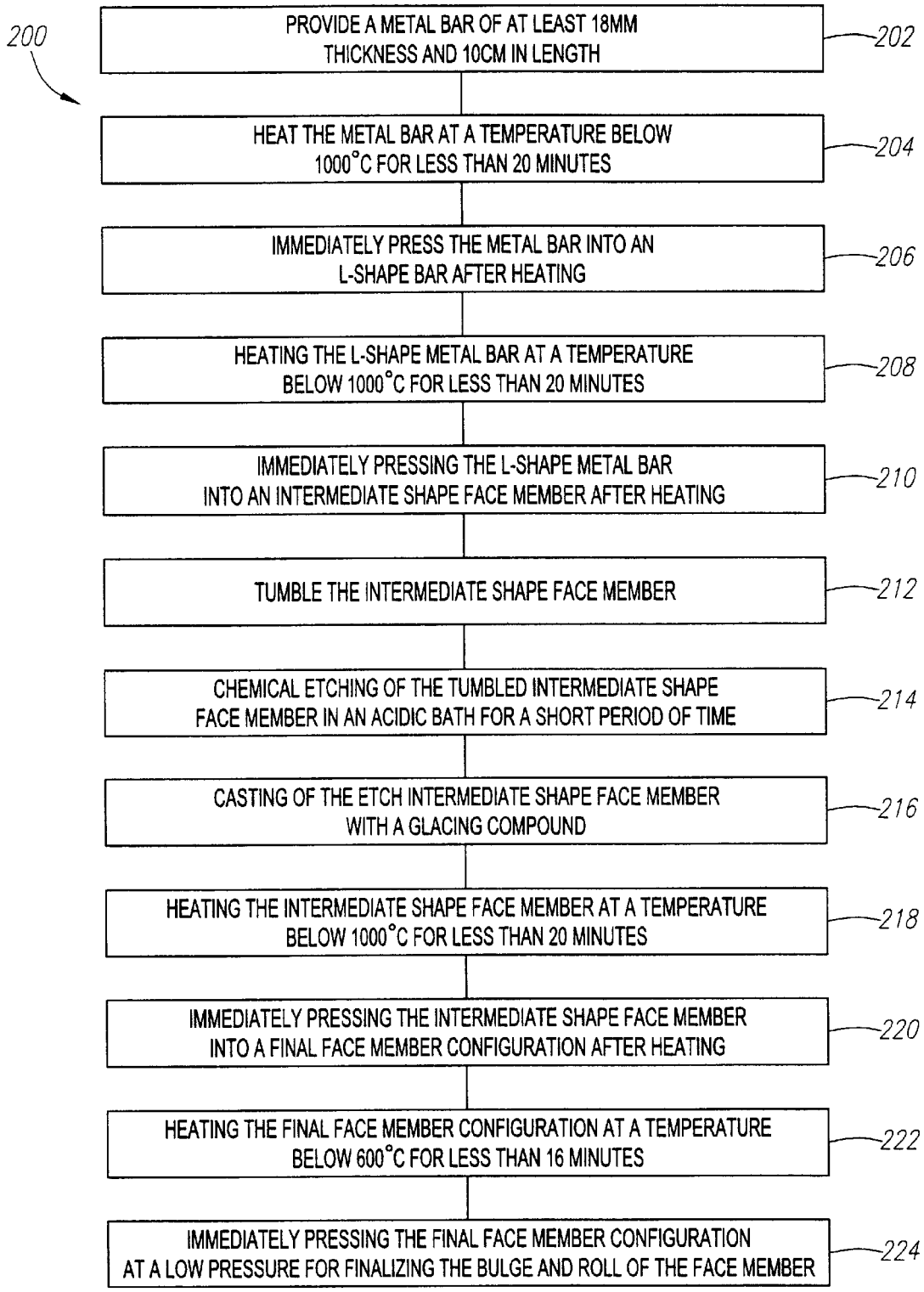
FIG. 8 is a flow chart of the method of the present invention.

FIG. 8 is a flow chart of the method of the present invention, generally designated 200. The method 200 commences at block 202 with a metal bar being provided for forging into a face member 60. The metal bar preferably has a diameter of 1.8 centimeters and is preferably 10 centimeters in length. The metal bar is preferably composed of titanium, and most preferably alpha-beta titanium. At step 204, the metal bar is heated in a furnace at a temperature less than 1000° C. for less than 20 minutes. Preferably, the metal bar is heated in a rotary furnace at a temperature between 900° C. and 970° C., most preferably 920° C., for between 10 and 17 minutes, preferably 15 minutes. At step 206, the heated metal bar is pressed immediately after removal from the furnace into an L-shape bar. The L-shape bar, has a smaller portion that is pressed at substantially a right angle to a larger portion of the metal bar. The pressing is performed in a conventional press at conventional pressures.

At step 208, the L-shape metal bar is again heated in a furnace at a temperature less than 1000° C. for less than 20 minutes. Preferably, the L-shape metal bar is heated in a rotary furnace at a temperature between 900° C. and 970° C., most preferably 920° C., for between 10 and 17 minutes, preferably 15 minutes. At step 210, the heated metal bar is pressed immediately after removal from the furnace into an intermediate shape face member.

At step 212, the intermediate shape face member is placed in a tumbler for tumbling to improve the surface condition of the intermediate shape face member. At step 214, the tumbled, intermediate shape face member is placed in an acidic bath for a light chemical etching to remove dirt and other particles on the surface. The acidic bath is preferably composed of a nitric acid, a hydrochloric acid, or a mixture of both. At step 216, the etched, intermediate shape face member is coated with a conventional glazing coating, such as DELTAGLAZE 153 available from Acheson Colloids Company of Michigan, to provide lubrication during the final full pressure pressing to form the final configuration.

At step 218, the coated, intermediate shape face member is heated in a furnace at a temperature less than 1000° C. for less than 20 minutes. Preferably, the coated, intermediate shape face member is heated in a rotary furnace at a temperature between 900° C. and 970° C., most preferably 920° C., for between 10 and 17 minutes, preferably 15 minutes. At step 220, the heated, intermediate shape face member bar is pressed immediately after removal from the furnace into a final face member configuration. The final face member configuration preferably has a variable face thickness as set forth in FIGS. 6 and 7. Further, the final face member configuration has the face extension with the upper lateral extension 76, the lower lateral extension 78, the heel wall 80 and the toe wall 82.

At step 222, a hot set operation is begun to ensure that the striking plate 72 of the final face member configuration has a proper bulge and roll. At step 222, the final face member configuration is heated in a furnace at a temperature less than 600° C. for less than 20 minutes. Preferably, the final face member configuration is heated in a furnace at a temperature of 250° C. to 520° C. for 15 to 20 minutes, and most preferably 300° C. At step 224, the heated final face member configuration is immediately placed in a low pressure press for ensuring the proper bulge and roll of the striking plate 72. After step 224, the face member 60 has finished the forging process, and is ready for assembly with the other components of the golf club head 42.

Figure 9:
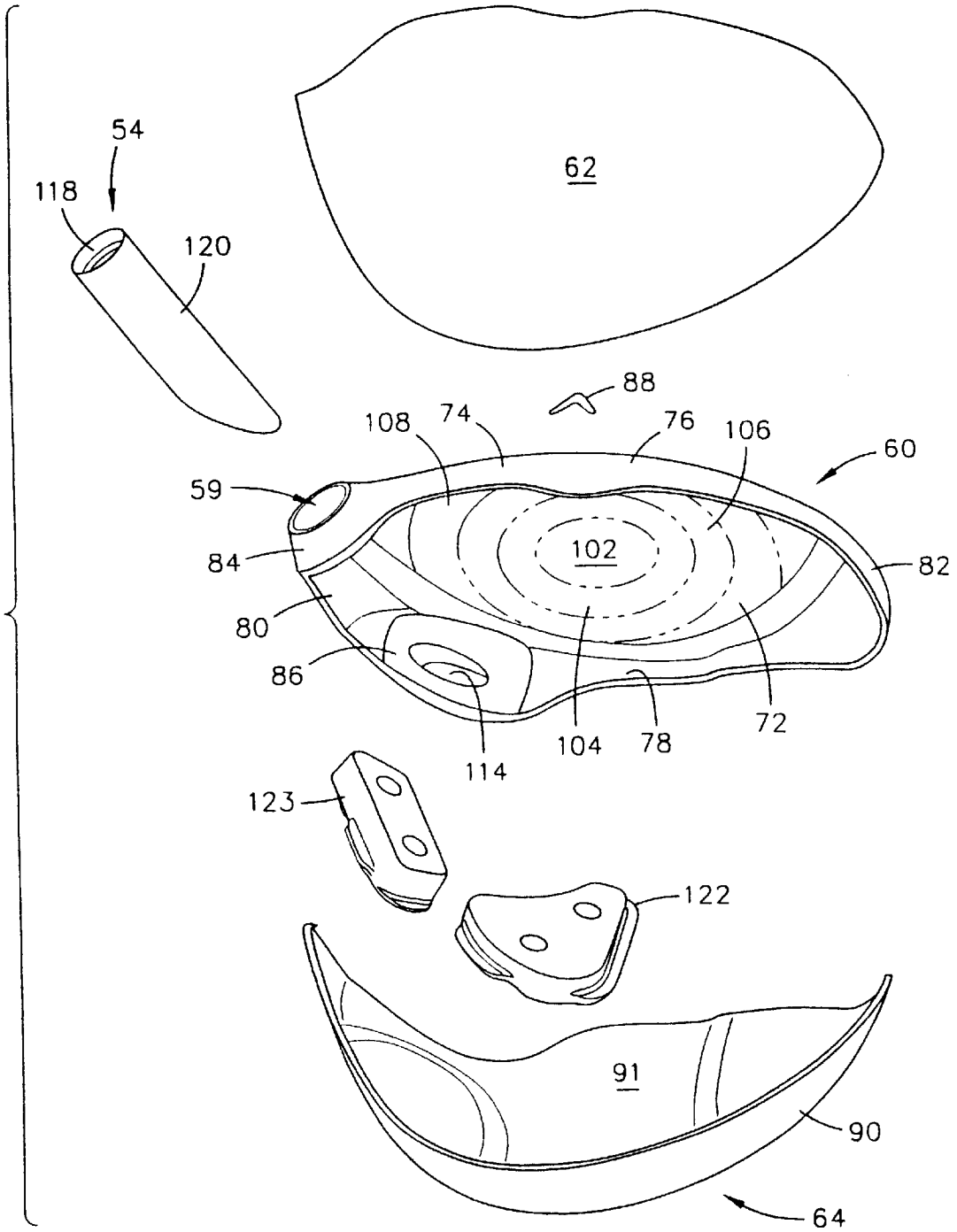
FIG. 9 is an exploded view of the components of a golf club head produced according to the method of the present invention.
Figure 10:
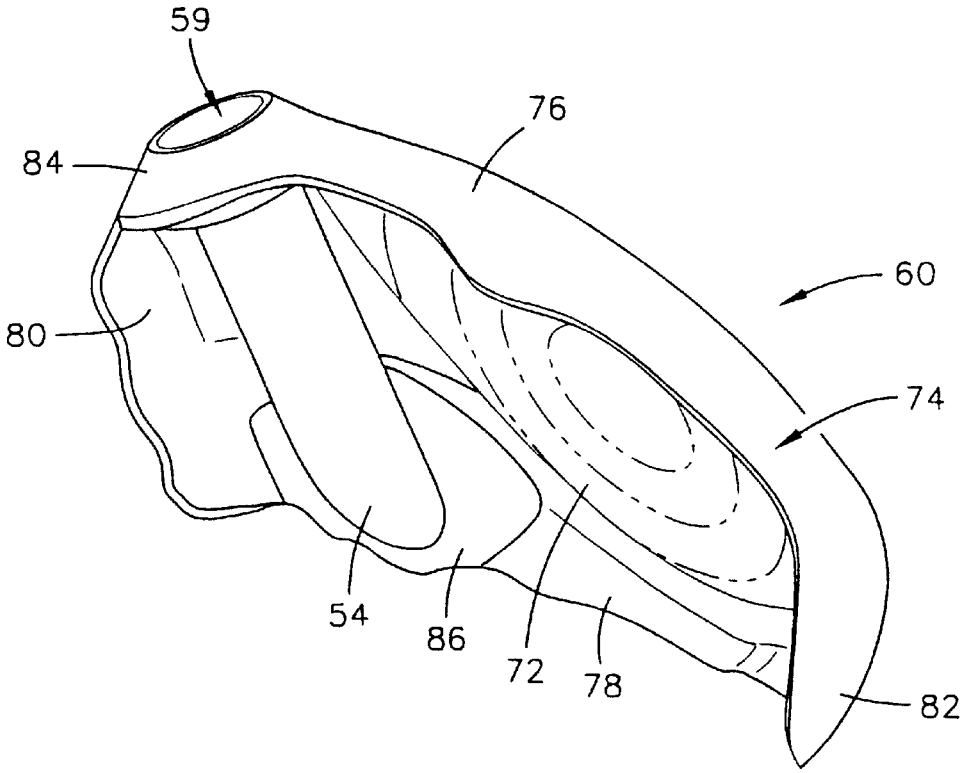
FIG. 10 is an isolated view of the face member of FIG. 9.
Figure 11:
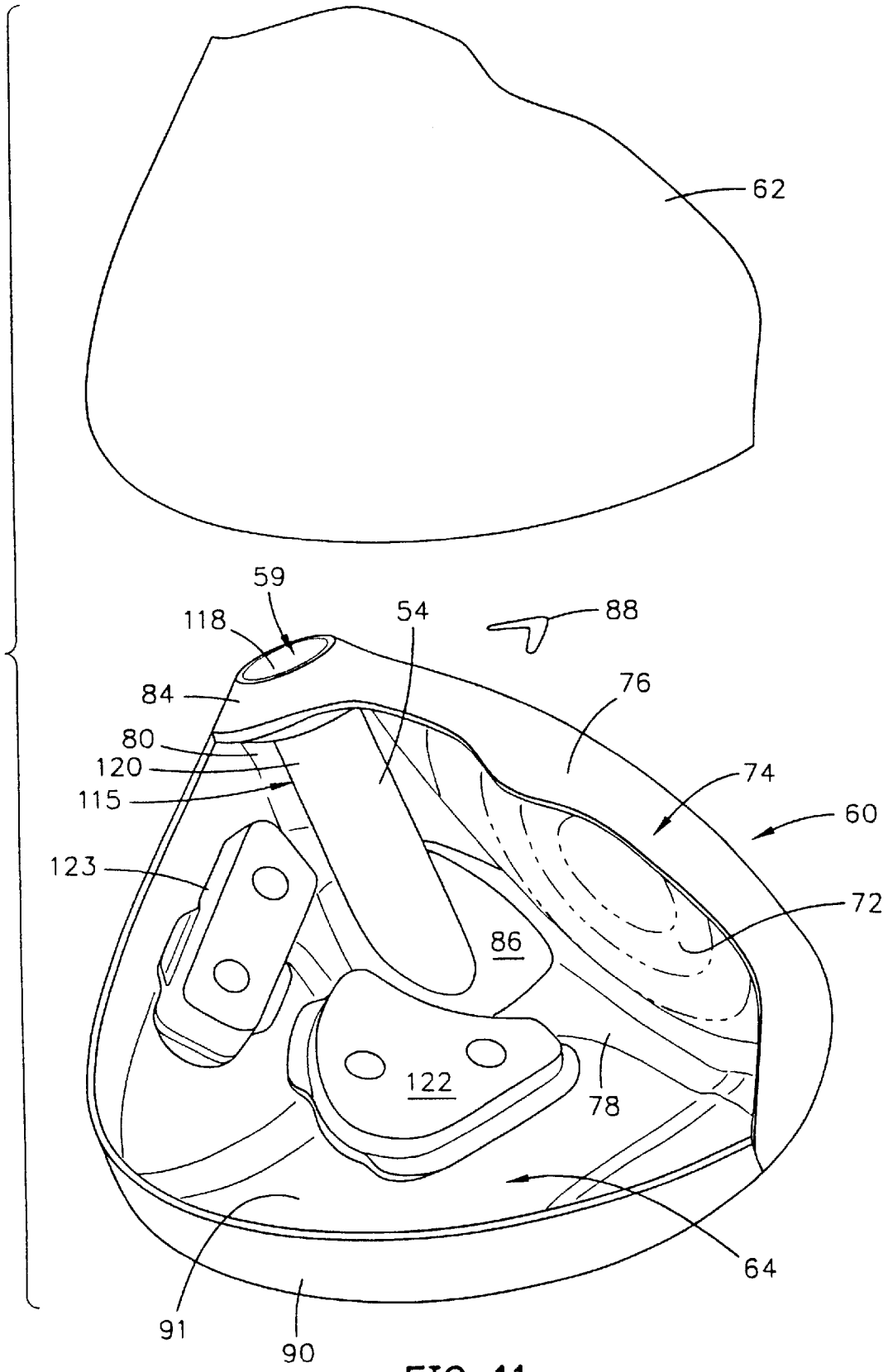
FIG. 11 is an exploded view of the crown and the connected sole and face member.

FIGS. 9–11 illustrate a preferred assembly of the different components of the golf club head 42. Essentially there are four main components, the face member 60, the crown 62, the sole 64 and the interior hosel 54. Sub-components include two weight members 122 and 123 and a decal 88. The face member 60 is formed in the forging process 200 to create the striking plate 72 and face extension 74 with the upper lateral extension 76, the lower lateral extension 78, the heel wall 80 and the toe wall 82. The aperture 59 is drilled in the hosel section 84 of the upper lateral extension 76, after forging, and the drilling continues downward to the bore section 86 where the bore 114 is created in the bore section 86.

Next, as shown in FIG. 10, the interior hosel 54 is welded to the hosel section 84 and the bore section 86 in alignment with the aperture 59 and the bore 114. In a preferred embodiment, a sold cylinder is welded to the hosel section 84 and the bore section 86 in alignment with the aperture 59 and the bore 114, and then the solid cylinder is reamed to create the hollow interior 118 of the interior hosel 54, as defined by the hosel wall 120. In an alternative embodiment, the interior hosel may be pre-reamed prior to welding to the face member 60. Those skilled in the pertinent art will recognize that methods similar to welding may be employed for attachment of the hosel 54 to the face member 60 without departing from the scope and spirit of the present invention. Next, the sole 64 is welded to the face member 60 (with attached hosel 54) as shown in FIG. 11. The weight members 122 and 123 are attached on the bottom section 91 of the sole 64, and then the crown 62 is welded to the face member 60 and the ribbon section 90.

Figure 12:
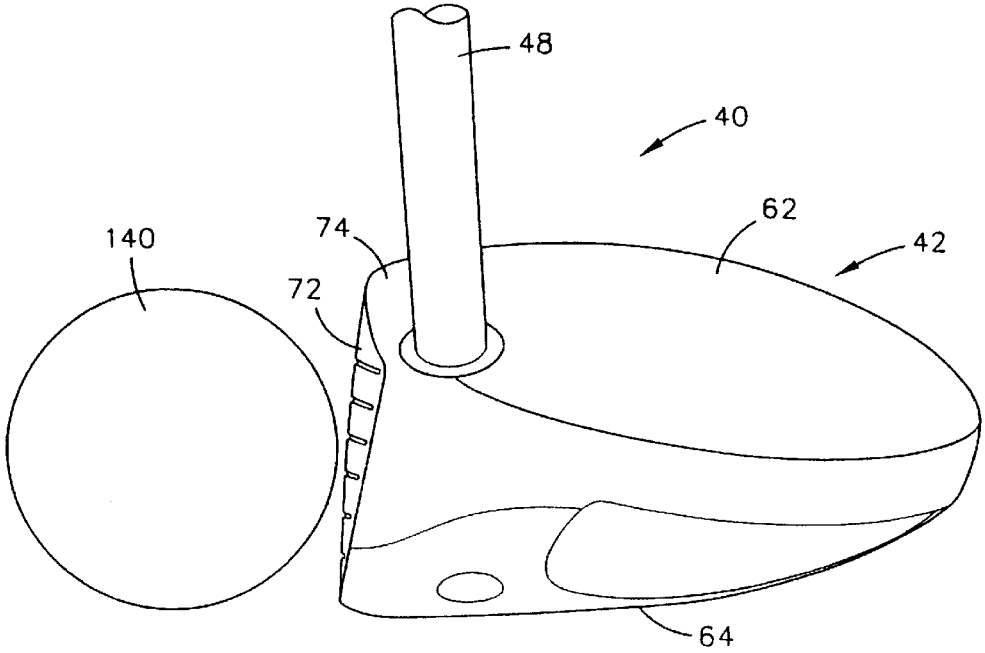
FIG. 12 is a side view of a golf club head produced according to the method of the present invention immediately prior to impact with a golf ball.
Figure 13:
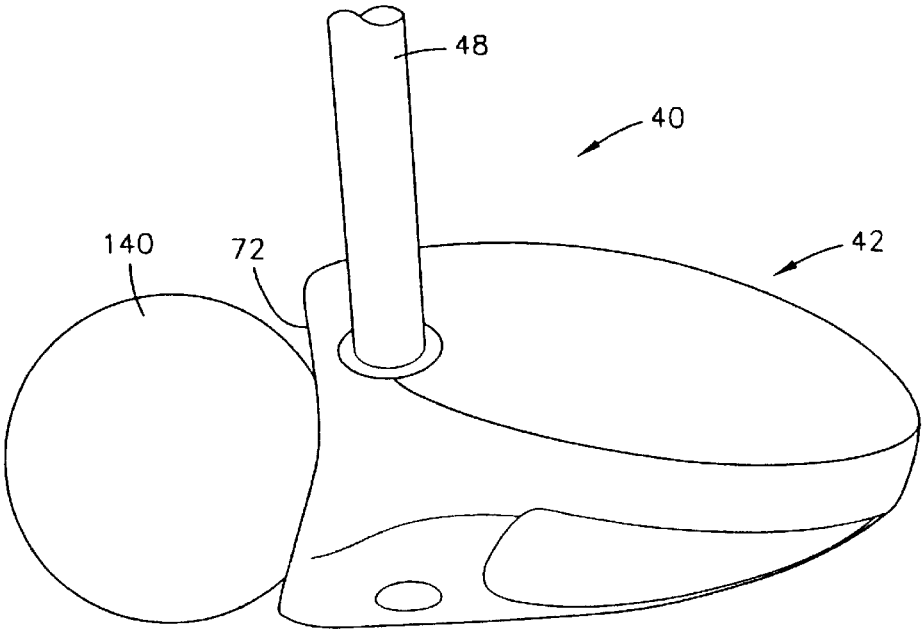
FIG. 13 is a side view of a golf club head produced according to the method of the present invention during impact with a golf ball.
Figure 14:
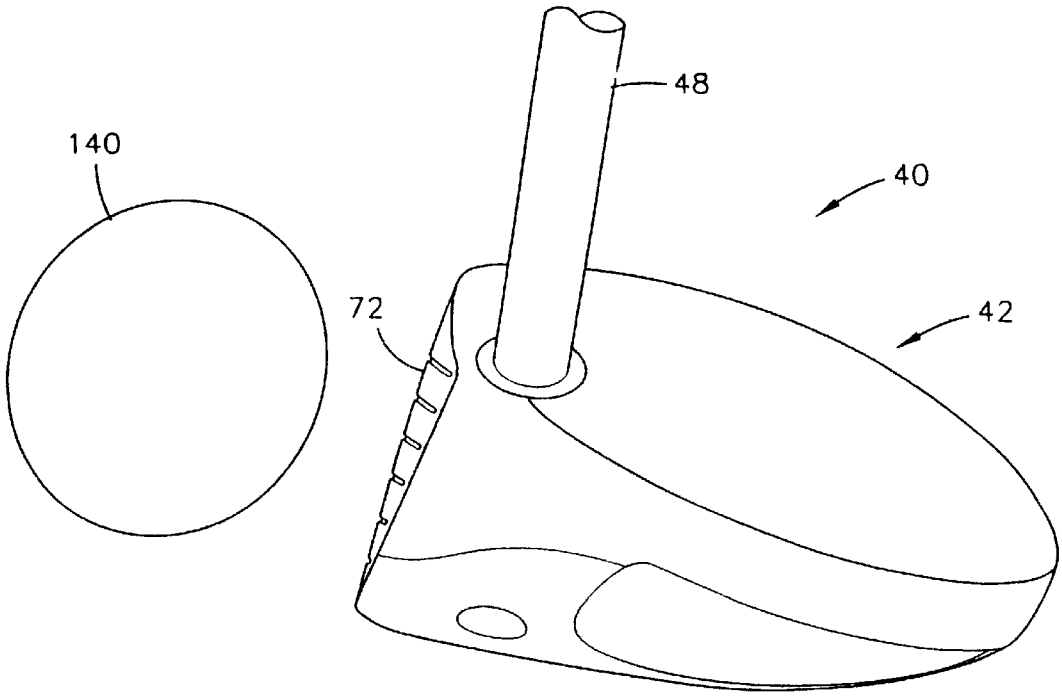
FIG. 14 is a side view of a golf club head produced according to the method of the present invention immediately after impact with a golf ball.

As shown in FIGS. 12–14, the compliance of the striking plate 72 allows for a greater coefficient of restitution, in the range of 0.83 to 0.93 under test conditions such as the USGA test conditions specified pursuant to Rule 4-1e, Appendix II of the Rules of Golf for 1998–1999. At FIG. 12, the striking plate 72 is immediately prior to striking a golf ball 140. At FIG. 13, the striking plate 72 is engaging the golf ball, and deformation of the golf ball 140 and striking plate 72 is illustrated. At FIG. 14, the golf ball 140 has just been launched from the striking plate 72. Thus, unlike a spring, the present invention increases compliance of the striking plate to reduce energy losses to the golf ball at impact, while not adding energy to the system.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for producing a face member for a golf club head, the method comprising:

heating a cylindrical metal bar having a diameter of 1.8 centimeters and a length of 10 centimeters to a temperature ranging from 900° C. to 970° C. for a time period ranging from 10 minutes to 17 minutes;

pressing the heated cylindrical metal bar into an L-shape metal bar;

heating the L-shape metal bar to a temperature ranging from 900° C. to 970° C. for a time period ranging from 10 minutes to 17 minutes;

pressing the L-shape metal bar into an intermediate shape face member;

placing the intermediate shape face member into a tumbler for tumbling;

coating the intermediate shape face member with a glazing compound;

heating the coated intermediate shape face member ranging from 900° C. to 970° C. for a time period ranging from 10 minutes to 17 minutes; and immediately pressing the heated intermediate shape face member into a final face member configuration having a thickness in the range of 0.010 inch to 0.250 inch; and wherein the final face member comprises an upper lateral extension, a lower lateral extension, a heel wall a toe wall opposite the heel wall, and wherein the final face member extends laterally inward along its entire perimeter.

2. The method according to claim 1 further comprising:

heating the final face member configuration to a temperature ranging from 250° C. to 520° C. for up to 20 minutes; and pressing the heated final face member configuration in a press at a low pressure that is less than the pressure of any of the three previous pressings, the low pressure pressing ensuring proper bulge and roll of the final face member configuration.

3. The method according to claim 1 wherein the cylindrical metal bar is composed of titanium.

4. The method according to claim 3 wherein the cylindrical metal bar is beta titanium and the final face member configuration is composed of beta titanium and alpha titanium.

5. The method according to claim 1 wherein pressing the heated intermediate shape face member comprises pressing the heated intermediate shape into a final face member configuration with a variable thickness.

6. A golf club head manufactured by the method according to claim 5 wherein the final face member configuration has a striking plate with concentric regions of varying thickness with the thickest region in the center.

7. A golf club head manufactured by the method according to claim 5 wherein the final face member configuration has a striking plate comprising a central circular region having a base thickness, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness.

8. The method according to claim 5 wherein the final face member configuration comprises a striking plate having an exterior surface, an interior surface and a perimeter, and a face extension extending laterally inward along the entire perimeter of the striking plate, the face extension having an upper portion, a lower portion opposite the upper portion, a heel wall substantially perpendicular to the plate portion, and a toe wall opposite the heel wall.

9. A method for producing a face member for a golf club head, the method comprising:

heating a titanium cylindrical bar to a temperature between 900° C. and 975° C. for a time period ranging from 10 to 17 minutes, the titanium cylindrical bar having a diameter less than 2 centimeters and a length of 10 centimeters;

pressing the heated titanium bar into an L-shape bar;

heating the L-shape bar to a temperature between 900° C. and 975° C. for a time period ranging from 10 minutes to 17 minutes;

pressing the heated L-shape bar into an intermediate shape face member;

coating the intermediate shape face member with a glazing compound;

heating the coated intermediate shape face member to a temperature between 900° C. and 975° C. for a time period ranging from 10 to 17 minutes;

pressing the heated intermediate shape face member into a final face member configuration having an upper lateral extension, a lower lateral extension, a heel wall, and a toe wall;

heating the final face member configuration to a temperature ranging between 250° C. and 520° C. for a period of between 15 to 20 minutes;

pressing the heated final face member configuration in a press at a low pressure that is less than the pressure of any of the three pressings, the low pressure pressing ensuring proper bulge and roll of the final face member configuration; and drilling a hosel aperture through the upper lateral extension extending down through the lower lateral extension.

10. The method according to claim 9 wherein the final face member configuration has a thickness in the range of 0.010 inch to 0.250 inch.

11. A golf club head manufactured by the method according to claim 9 wherein the final face member configuration has concentric regions of varying thickness with the thickest region in the center.

12. A golf club head manufactured by the method according to claim 9 wherein the final face member configuration has a striking plate comprising a central circular region having a base thickness, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness.

13. A method for producing a face member for a golf club head, the method comprising:

heating a cylindrical metal bar to a temperature between 900° C. and 975° C. for a time period ranging from 10 to 17 minutes;

pressing the heated cylindrical metal bar into an L-shape metal bar;

heating the L-shape metal bar to a temperature between 900° C. and 975° C. for a time period ranging from 10 to 17 minutes;

pressing the L-shape metal bar into an intermediate shape face member;

coating the intermediate shape face member to a temperature between 900° C. and 975° C. for a time period ranging from 10 to 17 minutes; and pressing the heated intermediate shape face member into a final striking plate configuration, the final face member configuration comprising a striking plate with an aspect ratio ranging from 1.0 to 1.7 having an exterior surface, an interior surface and a perimeter, and a face extension extending laterally inward along the entire perimeter of the striking plate, the face extension having an upper portion, a lower portion opposite the upper portion, a heel wall perpendicular to the striking plate, and a toe wall opposite the heel wall.

14. The method according to claim 13 wherein the cylindrical metal bar is composed of titanium, has a diameter less than 2 centimeters and a length of 10 centimeters.

15. A golf club head manufactured by the method according to claim 13 wherein the striking plate of the final face member configuration comprises a central circular region having a base thickness, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness.

* * * * *